United States Patent [19]

Ehrich

[11] Patent Number: 5,029,860

[45] Date of Patent: Jul. 9, 1991

[54] COLLAPSIBLE GOLF CLUB

[76] Inventor: James D. Ehrich, 27251 Lavinka St., Bonita Springs, Fla. 33923

[21] Appl. No.: 441,148

[22] Filed: Nov. 24, 1989

[51] Int. Cl.[5] ..... A63B 53/16

[52] U.S. Cl. ..... 273/81.2; 273/80 D

[58] Field of Search ..... 273/80 D, 81.2, 80 R, 273/77 R, 84 R; 248/188.5; 16/115, DIG. 41; 15/143 B, 144 B; 81/177.2; 403/109; 135/69, 75, 108

[56] References Cited

U.S. PATENT DOCUMENTS

| | | | |
|---|---|---|---|
| 1,185,732 | 6/1916 | Swayne | 15/143 B |
| 1,406,841 | 2/1922 | Foss | 16/115 |
| 1,569,765 | 1/1926 | Lowell | 273/81.2 |
| 1,650,183 | 11/1927 | Brooks | 273/81.2 |
| 3,528,660 | 9/1970 | Kategian | 273/81.2 |
| 3,539,185 | 11/1970 | Andis | 273/81.2 |
| 4,134,703 | 1/1979 | Hinners | 248/188.5 X |
| 4,674,747 | 6/1987 | Mazzocco et al. | 273/81.2 |

FOREIGN PATENT DOCUMENTS

| | | | |
|---|---|---|---|
| 732978 | 4/1966 | Canada | 273/80 D |
| 2617406 | 1/1989 | France | 273/80 D |

OTHER PUBLICATIONS

Advertisement for 'Taperscopic'.

*Primary Examiner*—Edward M. Coven
*Assistant Examiner*—Sebastiano Passaniti
*Attorney, Agent, or Firm*—Thomas J. Dodd

[57] ABSTRACT

A golf club which includes an overlength shaft which includes telescopically connected tubular shaft members. The shaft members are shiftable between an extended operative position with the shaft members secured one to the other and a collapsed, inoperative position in which one shaft member fits loosely inside the other.

4 Claims, 1 Drawing Sheet

COLLAPSIBLE GOLF CLUB

SUMMARY OF THE INVENTION

This invention relates to golf clubs and will have specific application to a collapsible putter which includes an extra long shaft.

Long shafted putters have recently become very popular, particularly with senior golfers due mainly to successful use of the clubs on the Senior PGA Tours. SUch putters normally include conventional putter heads affixed to an extra long shaft (normally 46 inches or more in overall length as compared with the standard 35 inch putter shaft).

Long shafted putters present special problems of their own. Since they are longer than any other golf club in the average person's bag, the putter head protrudes above the other clubs and often gets in the way when the player is selecting a tee or fairway club to strike the ball. Most importantly, long shafted putters present difficulties in transport to and from the course, whether in the truck of a car or on aircraft. Numerous instances of shaft breakage have been reported, which results in both inconvenience and expense, particularly to the average golfer.

The long shafted putter of this invention includes first and second tubular members which are telescopically connected to each other. The tubular members are connected in the operative position by mating threads. When the threads are disconnected, the putter may be collapsed to allow for convenient storage and transport.

Accordingly, it is an object of this invention to provide for a golf club which has a collapsible shaft.

Another object is to provide for a collapsible long shafted putter which is convenient to store and transport in a conventional golf bag.

Another object is to provide for a collapsible golf club which conforms to all of the rules of golf as determined by both the U.S. Golf Association and the Royal and Ancient Golf Club of St. Andrews, Scotland.

Other objects of this invention will become apparent upon a reading of the following description

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Figure 1:
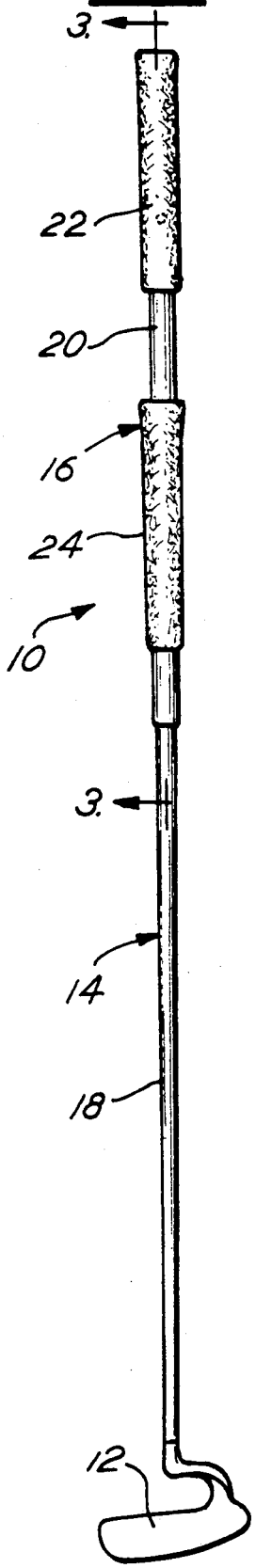
FIG. 1 is an elevation view of the collapsible golf club of this invention shown in its operative extended position.

Referring now to the drawings, reference numeral 10 refers generally to the collapsible golf club which forms the subject matter of this invention. As is common on all golf clubs, club 10 includes generally a ball striking head 12, a shaft 14 and a grip 16. In the embodiment shown in FIGS. 1 and 2 head 12 is a putter head of common variety, although it is understood that the principles of this invention apply with equal weight to virtually all golf club heads.

Club 10 illustrated is common referred to as an overlength putter, very popular on the Senior PGA Tour. The shaft 12 of club 10 includes a first tubular shaft 18 and second tubular shaft 20. As is common with these putters grip 16 will preferably include separated common grip members 22 and 24 attached to shaft 20. Shaft 18 is attached to head 12 in a common manner, usually by epoxy cement.

In the embodiment shown shaft 18 fits telescopically inside shaft 20.

Figure 3:
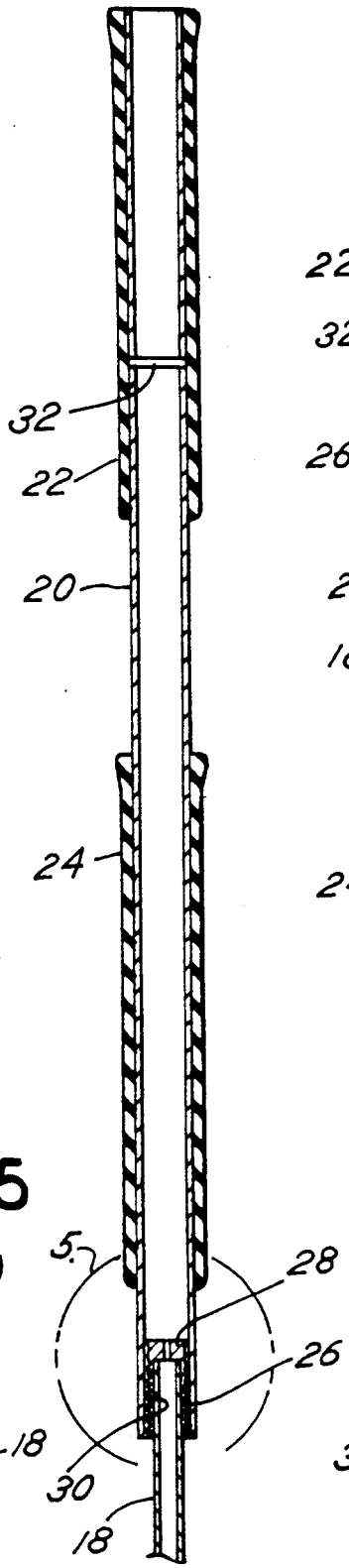
FIG. 3 is a sectional view taken along line 3—3 of FIG. 1.
Figure 4:
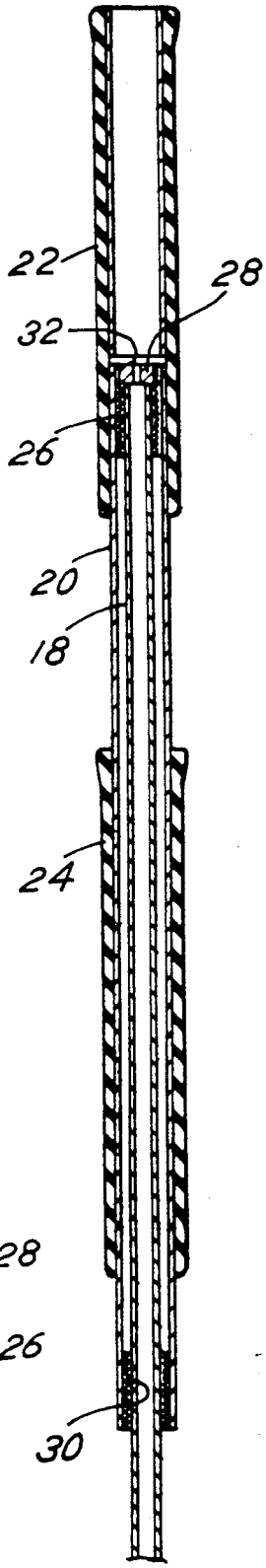
FIG. 4 is a sectional view taken along line 4—4 of FIG. 2.
Figure 5:
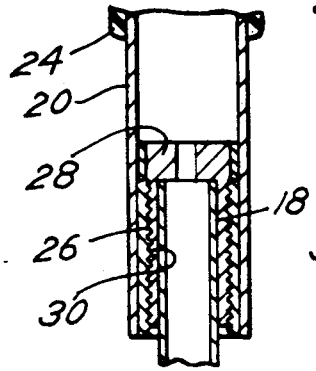
FIG. 5 is a detail view of the shaft connecting threads taken from broken circle 5 in FIG. 3.

In practice, this orientation could be reversed if desired if a thinner grip and large bottom shaft 18 were deemed desirable. As shown in FIGS. 3–5, shaft 18 includes an upper threaded portion 26 and an uppermost smooth surfaced end cap 28. Shaft 20 includes lower internal threads 30 which mate with threaded portion 26 to secure club 10 in its extended operative position of FIGS. 1 and 3. End cap 28 acts as a stop to prevent overextending of shaft 12, whose overall length is preferably forty inches to fifty-six inches in length or more.

Figure 2:
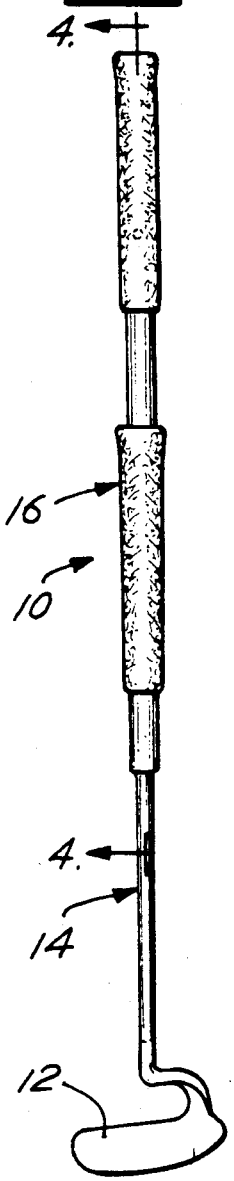
FIG. 2 is an elevation view of the club in its inoperative retracted position.

To collapse club 10 into the inoperative position of FIGS. 2 and 4, the user turns shaft 10 to disengage threads 26, 30. Since shaft 18 has an internal diameter less than the internal diameter of threads 30, shaft 18 may be slid telescopically into shaft 20 until end cap 28 contacts stop plug or bar 32 secured within shaft 20. It should be noted that club 10 is inoperative in a practical sense, when in the collapsed position of FIGS. 2 and 4 due to the fact that shaft 18 fits somewhat loosely in shaft 20 which would produce significant wobble if a player attempted to strike a ball with the shaft collapsed. This inoperativeness is necessary to comply with the rules of golf which prohibit the use of golf clubs with more than one effective shaft length. So collapsed, club 10 may be transported as a conventional length club.

It is understood that any acceptable means of securement of shafts 18, 20 may be utilized which are equivalent to shaft threaded portions 26, 30. The invention is not to be limited to the details above given but may be modified within the scope of the appended claims.

I claim:

1. In a golf club including a head means for striking a golf ball, an elongated shaft connected to said head means, and grip means for improving a player's grip on said club affixed to said shaft, the improvement wherein said shaft is of a significantly greater length than a standard length club, said shaft including a first tubular member connected to said head means, and a second tubular member, securement means telescopically connecting said first and second tubular members wherein said shaft is shiftable between an operative extended position with the first and second tubular members connected by said securement means, and an inoperative collapsed position with the securement means disconnected and one of the first and second tubular members sliding freely within the other of said first and second tubular members, said securement means including internal threads located in one of said first and second tubular members, external threads on the other of said first and second tubular members matable with said internal threads to produce said operative position, said tubular member having said internal threads including an end cap connected thereto, said end cap constituting means for halting relative shifting movement of said tubular members when in said operative extended position.

2. The golf club of claim 1 wherein said head means is a putter head, and said shaft measures at least forty inches in overall length.

3. The golf club of claim 1 wherein said second tubular member includes internal stop means for limiting travel of said first tubular member towards said inoperative collapsed position.

4. The golf club of claim 3 wherein said internal stop means includes a stop plug spanning an interior dimension of said second tubular member.

* * * * *